US008459476B2

(12) United States Patent
Malekmadani

(10) Patent No.: US 8,459,476 B2
(45) Date of Patent: Jun. 11, 2013

(54) AUDIO / VIDEO ISOLATION RACK

(76) Inventor: Mohammad Ghassem Malekmadani, Palo Alto, CA (US)

( * ) Notice: Subject to any disclaimer, the term of this patent is extended or adjusted under 35 U.S.C. 154(b) by 1040 days.

(21) Appl. No.: 11/653,414

(22) Filed: Jan. 11, 2007

(65) Prior Publication Data

US 2007/0187348 A1 Aug. 16, 2007

Related U.S. Application Data

(60) Provisional application No. 60/761,219, filed on Jan. 11, 2006.

(51) Int. Cl.

| | |
|---|---|
| ***A47B 87/0207*** | (2006.01) |
| ***A47B 87/0246*** | (2006.01) |
| ***A47B 87/0215*** | (2006.01) |
| ***A47B 87/0223*** | (2006.01) |

(52) U.S. Cl.

USPC ..... 211/188; 211/194; 211/134; 211/189

(58) Field of Classification Search

USPC ..... 211/188, 186, 187, 194, 131.1, 182, 211/189, 126.2, 126.11, 126.12, 134; 108/190, 108/187, 91, 92; 312/114, 108

See application file for complete search history.

(56) References Cited

U.S. PATENT DOCUMENTS

| | | | | | |
|---|---|---|---|---|---|
| 1,867,738 | A | * | 7/1932 | Fraser | 206/449 |
| 2,944,780 | A | * | 7/1960 | Monk | 248/218.4 |
| 3,221,394 | A | * | 12/1965 | Pitts | 29/825 |
| 3,424,111 | A | * | 1/1969 | Maslow | 108/147.13 |
| 3,682,323 | A | * | 8/1972 | Bergquist et al. | 211/74 |
| 3,783,801 | A | * | 1/1974 | Engman | 108/60 |
| 4,037,835 | A | * | 7/1977 | Forsyth | 482/27 |
| 4,128,064 | A | * | 12/1978 | Chung et al. | 108/192 |
| 4,204,096 | A | | 5/1980 | Barcus et al. | |
| 4,275,666 | A | * | 6/1981 | Schriever | 108/101 |
| 4,560,136 | A | | 12/1985 | Basore | |
| 4,596,195 | A | | 6/1986 | Wenger | |
| 4,687,173 | A | | 8/1987 | Genna | |
| 4,763,796 | A | * | 8/1988 | Flum | 211/59.2 |
| 4,843,975 | A | * | 7/1989 | Welsch et al. | 108/24 |
| 4,930,643 | A | * | 6/1990 | Flum | 211/188 |
| 5,027,961 | A | * | 7/1991 | Howitt | 211/188 |
| 5,056,669 | A | * | 10/1991 | Villeneuve | 211/40 |
| 5,366,200 | A | * | 11/1994 | Scura | 248/632 |
| 5,421,467 | A | * | 6/1995 | Dittborn | 211/150 |
| 5,584,398 | A | * | 12/1996 | Lin | 211/40 |
| 5,676,263 | A | * | 10/1997 | Chang | 211/187 |
| 5,715,954 | A | * | 2/1998 | Zaremba | 211/107 |
| 5,860,534 | A | * | 1/1999 | Minneman et al. | 211/13.1 |
| 5,881,653 | A | * | 3/1999 | Pfister | 108/147.13 |
| 5,909,863 | A | * | 6/1999 | Mansfield et al. | 248/235 |
| 5,964,360 | A | * | 10/1999 | Hwang | 211/186 |
| 5,997,117 | A | | 12/1999 | Krietzman | |
| 6,015,053 | A | * | 1/2000 | Sheng | 211/188 |
| 6,056,381 | A | | 5/2000 | Turner | |
| 6,062,150 | A | * | 5/2000 | Sikora et al. | 108/190 |
| 6,065,407 | A | * | 5/2000 | Wang | 108/147.13 |

(Continued)

*Primary Examiner* — Jennifer E Novosad
(74) *Attorney, Agent, or Firm* — Kolisch Hartwell, P.C.

(57) ABSTRACT

An apparatus and system for video and audio components. According to one embodiment, the present invention generally comprises carbon fiber composite shelves separated by carbon fiber posts and supported by carbon fiber legs. The posts and legs are secured by studs. Adjacent to at least the bottom surface of each of the shelves at each opening where a stud passes through is a polyurethane ring.

20 Claims, 6 Drawing Sheets

U.S. PATENT DOCUMENTS

| | | | | |
|---|---|---|---|---|
| 6,098,822 | A * | 8/2000 | Wohlford | 211/186 |
| 6,116,438 | A * | 9/2000 | Lovett | 211/194 |
| 6,247,414 | B1 * | 6/2001 | Sikora et al. | 108/190 |
| 6,318,572 | B1 * | 11/2001 | Lai | 211/196 |
| 6,401,946 | B1 * | 6/2002 | Chalasani et al. | 211/188 |
| 6,439,406 | B1 * | 8/2002 | Duhon | 211/131.1 |
| 6,550,730 | B1 * | 4/2003 | Hong | 248/219.4 |
| 6,631,877 | B1 * | 10/2003 | Crain et al. | 248/168 |
| 6,761,274 | B1 * | 7/2004 | Chen | 211/207 |
| 6,801,418 | B1 | 10/2004 | Epstein | |
| 6,908,000 | B2 * | 6/2005 | Craft et al. | 211/144 |
| 7,017,870 | B2 * | 3/2006 | Meyer | 248/125.8 |
| 7,207,450 | B1 * | 4/2007 | Franklin et al. | 211/205 |
| 7,531,758 | B2 * | 5/2009 | Grove | 177/119 |
| 7,640,868 | B2 * | 1/2010 | Morrison et al. | 108/91 |
| 7,767,963 | B1 * | 8/2010 | Fujii | 250/330 |
| 7,861,870 | B2 * | 1/2011 | Chiang et al. | 211/37 |
| 8,001,911 | B2 * | 8/2011 | Yankello et al. | 108/190 |
| 8,091,707 | B2 * | 1/2012 | Egan et al. | 206/523 |
| 2002/0097556 | A1 | 7/2002 | Lee | |
| 2003/0134718 | A1 * | 7/2003 | Kim | 482/54 |
| 2004/0239150 | A1 * | 12/2004 | Fukudome et al. | 296/193.07 |
| 2005/0039976 | A1 * | 2/2005 | Vu | 181/209 |
| 2005/0069690 | A1 * | 3/2005 | Walz et al. | 428/292.4 |
| 2005/0073224 | A1 * | 4/2005 | Livingston et al. | 312/265.6 |
| 2005/0281999 | A1 | 12/2005 | Hofmann et al. | |
| 2006/0067060 | A1 | 3/2006 | Zimlin | |
| 2007/0187348 | A1 * | 8/2007 | Malekmadani | 211/186 |
| 2007/0278170 | A1 * | 12/2007 | Wiebe | 211/187 |
| 2008/0061019 | A1 * | 3/2008 | Lin et al. | 211/187 |
| 2008/0156759 | A1 * | 7/2008 | Lai | 211/187 |
| 2010/0000950 | A1 | 1/2010 | Malekmadani | |
| 2010/0096352 | A1 * | 4/2010 | Wang | 211/187 |

* cited by examiner

AUDIO / VIDEO ISOLATION RACK

CROSS REFERENCE TO RELATED APPLICATIONS

The present application claims priority from U.S. Provisional Application Ser. No. 60/761,219 filed Jan. 11, 2006, which is incorporated herein by reference in its entirety for all purposes.

BACKGROUND OF THE INVENTION

1. Field of the Invention

The invention relates generally to shelf systems for audio and video components and more particularly to apparatuses and methods for construction of anti-vibration shelf systems.

2. Relevant Art

There are several steps in high quality audio/video reproduction. Starting from a high quality recorded media, CD or LP, the signal transfers from a player to a pre-amplifier and amplifier and others to speakers. This is a serial transfer and requires a well matched high performance component system for a high quality reproduction. Vibration interferes with this transfer and distorts the signals. Vibration of all sorts is the greatest detriment to high quality reproduction of music. The source of vibration may be external to the audio system, such as the noise from appliances like a refrigerator, forces resulting from movement such as a person or animal running in the room, or the wind or may be internal to the audio/video system such as speakers or the component's power. Regardless of the source, vibration distorts analogue and digital signals and causes loss of details and harmonics.

Vibration interfering with audio/video reproduction occurs at various frequencies. Human ears can generally detect such noises to about 20 KHz. While the audio perception may be limited, higher frequency vibration may also interfere with the audio or video components' performance.

High-quality audio/video reproduction requires a well matched system consisting of a high performance audio/video source, amplifier, speakers, cables and a rack to house everything. Like a chain, all components of the system contribute to a high performance audio/video experience. The system is only as good as its weakest link. No matter how good the CD player or the speakers, if the rack is not dissipating vibration, one will not experience the ultimate in audio/video reproduction.

The relationship between a system's dynamic properties and its response to an arbitrary vibration force F can be represented as:

$$MX''+CX'+KX=F$$

Where X is displacement (motion)of the system, X' velocity and X" is acceleration and, M represents mass, C damping and K stiffness of the system. A properly designed high-performance anti-vibration rack or shelf will virtually eliminate vibration, a significant detriment to music reproduction.

The selection of materials may also impact the performance of a system. Materials that minimize vibration exist. An example of such is carbon fiber composites.

Carbon fiber generally refers to carbon filament thread, or to felt or woven cloth made from those carbon filaments. The term carbon fiber is also used to mean any composite material made with carbon filament, such a material is sometimes also referred to as graphite-reinforced plastic.

Each carbon filament is made out of long, thin filaments of carbon sometimes transferred to graphite. A common method of making carbon filaments is the oxidation and thermal pyrolysis of polyacrylonitrile (PAN), a polymer used in the creation of many synthetic materials. Like all polymers, polyacrylonitrile molecules are long chains, which are aligned in the process of drawing continuous filaments. When heated in the correct conditions, these chains bond side-to-side (ladder polymers), forming narrow graphene sheets which eventually merge to form a single, jelly roll-shaped or round filament. The result is usually 93-95% carbon. Lower-quality fiber can be manufactured using pitch or rayon as the precursor instead of PAN. The carbon can become further enhanced, as high modulus, or high strength carbon, by heat treatment processes. Carbon heated in the range of 1500-2000° C. (carbonization) exhibits the highest tensile strength (820,000 psi or 5,650 MPa or 5,650 N/mm$^2$), while carbon fiber heated from 2500 to 3000° C. (graphitizing) exhibits a higher modulus of elasticity (77,000,000 psi or 531 GPa or 531 kN/mm$^2$).

There are several categories of carbon fibers: standard modulus (250 GPa), intermediate modulus (300 GPa), and high modulus (>300 GPa). The tensile strength of different yam types varies between 2000 and 7000 MPa. The density of carbon fiber is 1750 kg/m3.

Precursors for carbon fibers are PAN, rayon and pitch. In the past rayon was more used as a precursor and still is for certain specialized applications such as rockets and specific aerospace application. Carbon fiber filament yams are used in several processing techniques: the direct uses are for prepregging, filament winding, pultrusion, weaving, braiding and the like.

The filaments are stranded into a yam. Carbon fiber yam is rated by the linear density (weight per unit length=1 g/1000 m=tex) or by number of filaments per yam count, in thousands. For example 200 tex for 3,000 filaments of carbon fiber is 3 times as strong as 1,000 carbon fibers, but is also 3 times as heavy. This thread can then be used to weave a carbon fiber filament fabric or cloth. The appearance of this fabric generally depends on the linear density of the yam and the weave chosen. Carbon fiber is naturally a glossy black but colored carbon fiber is also available.

Carbon fiber may be used to reinforce composite materials, particularly the class of materials known as carbon fiber reinforced plastics. This class of materials is often used demanding mechanical applications. Carbon fiber's unique properties such as high stiffness, high strength, high damping, low density, and corrosion resistance are ideal for demanding applications. Carbon fiber/epoxy composites have mechanical properties such as the stiffness and strength of steel, and damping of 10 times more than aluminum at 30% lower density.

While non-polymer materials can also be used as the matrix for carbon fibers, due to the formation of metal carbides (i.e., water-soluble AIC), bad wetting by some metals, and corrosion considerations, carbon is used less frequently in metal matrix composite applications.

As such, there is a need for an apparatus that minimizes the effects of vibration on audio and video components. The present invention present a novel approach to the design, material selection and construction of an isolation rack that dampens vibration at all frequencies, dissipates the vibration energy and as a result, isolates the high performance audio/video source from deadly vibration resulting in high quality audio/video reproduction.

DETAILED DESCRIPTION OF PREFERRED EMBODIMENTS OF THE INVENTION

Various embodiments of the invention are described hereinafter with reference to the figures. It should also be noted that the figures are only intended to facilitate the description of specific embodiments of the invention. The embodiments are not intended as an exhaustive description of the invention or as a limitation on the scope of the invention. In addition, an aspect described in conjunction with a particular embodiment of the invention is not necessarily limited to that embodiment and can be practiced in any other embodiment of the invention.

The present invention discloses a device for audio and video components that minimizes the effect of vibration, oscillation and the like.

Figure 1:
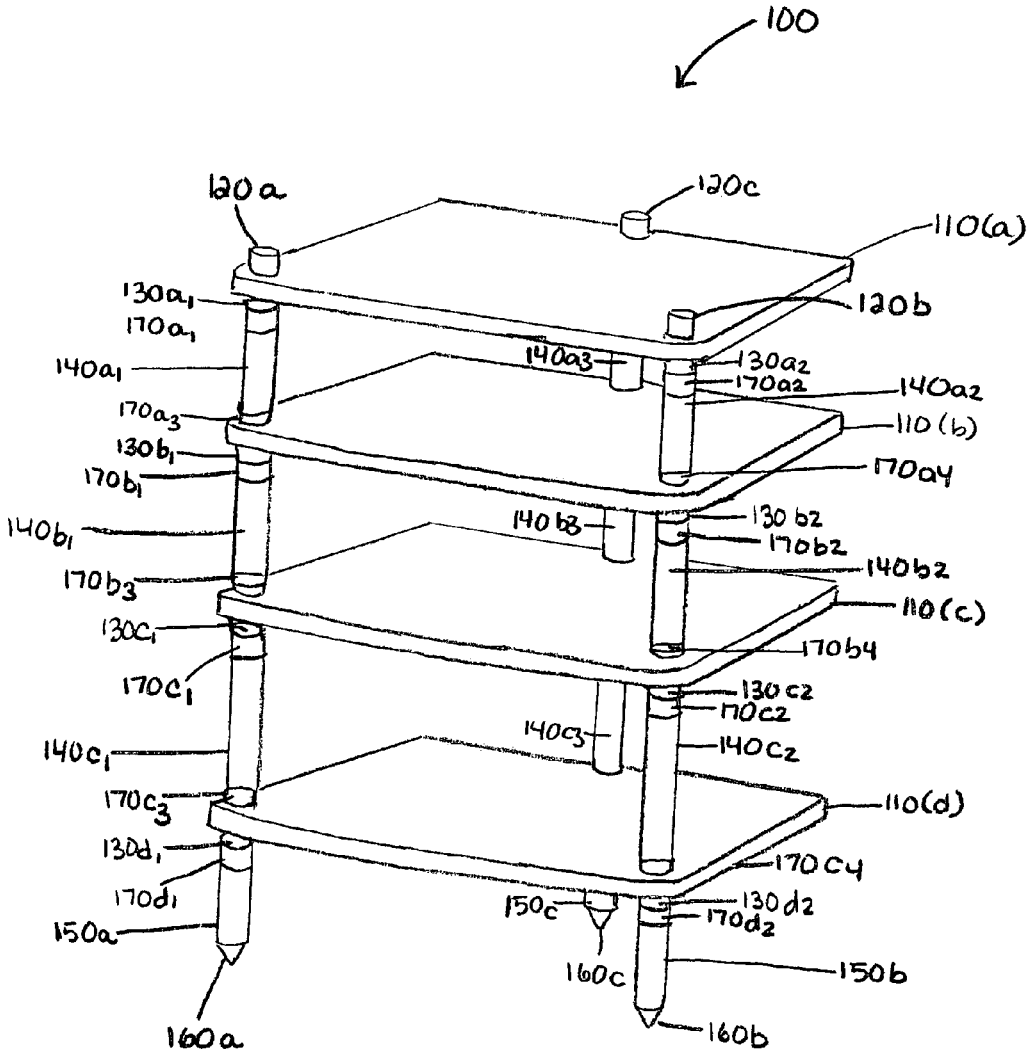
FIG. 1 is a perspective view of an audio/video shelf system in accordance with an embodiment of the present invention.

FIG. 1 illustrates an isolation rack system 100 for audio and video components constructed in accordance with an embodiment of the present invention. The isolation rack system 100 generally comprises shelves 110 (*a-d*), separated by posts 140 ($a_1$-$c_3$) and supported by legs 150 (*a-c*). The posts 140($a_1$-$c_3$) and legs 150 (*a-c*) are secured to the shelves 110 (*a-b*) by studs (not shown). Adjacent to at least the bottom surface of each of the shelves 110 (*a-d*) is a ring 130 ($a_1$-$d_2$). The rings adjacent to the bottom surface of each shelf at the backmost posts 140($a_3$-$c_3$) are not shown. There may also be rings 130 adjacent to the top surface of the shelf (not shown). Adjacent to the surface on the uppermost shelve is a nut 120 (*a-c*), also referred to as a top nut. At the base of each leg 150(*a-c*) there may be a spike (not shown), alternatively, at the base of each leg 150 (*a-c*) there may be a conical pad or foot 160 (*a-c*) or a pad, that may be a cylindrical pad (not shown).

The isolation rack system 100 is preferably designed and manufactured using many aerospace structural and isolation features that result in a superior sound reproduction of high-end components. The isolation rack system 100 is preferably constructed primarily from materials that assist in minimizing vibration and other interference. Carbon fiber composites are one such material and are one of the best materials for these purposes. Various acrylics are also suitable for such purpose. In contrast, glass and metals are the worst in damping and minimizing the effects of vibration, oscillation and the like.

Carbon fiber composite materials offer an excellent damping/stiffness combination. When a structure, like an audio/video rack is designed properly, it dissipates vibration the most effectively as it utilizes stiffness, damping and mass. That dissipation may be maximized by selecting a material well suited for the purpose, a carbon fiber composite is such a material. The shelves 110 (*a-d*) are of a thickness sufficient to support the weight of the audio and video components. Preferably, the shelves are approximately 1" thick. The shelves 110 (*a-d*) may be constructed from carbon fiber, either as a solid piece, i.e. constructed from a molding or extrusion process or in the form of multiple plys of sheets of carbon fiber, i.e. laminate construction. Alternatively, the shelves may be constructed from medium-density fiberboard ("MDF") or MDF with a carbon fiber veneer. Furthermore, the shelves 110 (*a-d*) may also be constructed from acrylics or similar plastic materials such as polymethyl methacrylate (also known as "acrylic glass" and "Plexiglas®"), the synthetic polymer of methyl methacrylate, or an acrylic with a carbon fiber veneer. When a carbon fiber veneer is used, the veneer is $^{10}/_{1000}$ to $^{999}/_{1000}$ inch thick and preferably $^{30}/_{1000}$ to $^{35}/_{1000}$ inch thick. The carbon fiber veneer described above is a multi layer carbon fiber skin (i.e. a laminate process) which is bonded to all surfaces (top, bottom and sides) of the MDF or acrylic to create the shelf. The carbon fiber veneers are preferably placed and cut at optimal angles, such that oblique angles are created between the plans of the sheets, to maximize its stiffness, strength and damping characteristics. The details of such are disclosed with respect to end caps below. In addition, ional metal wire may be added to the carbon fiber fabric to enhance shielding capability.

Figure 7:
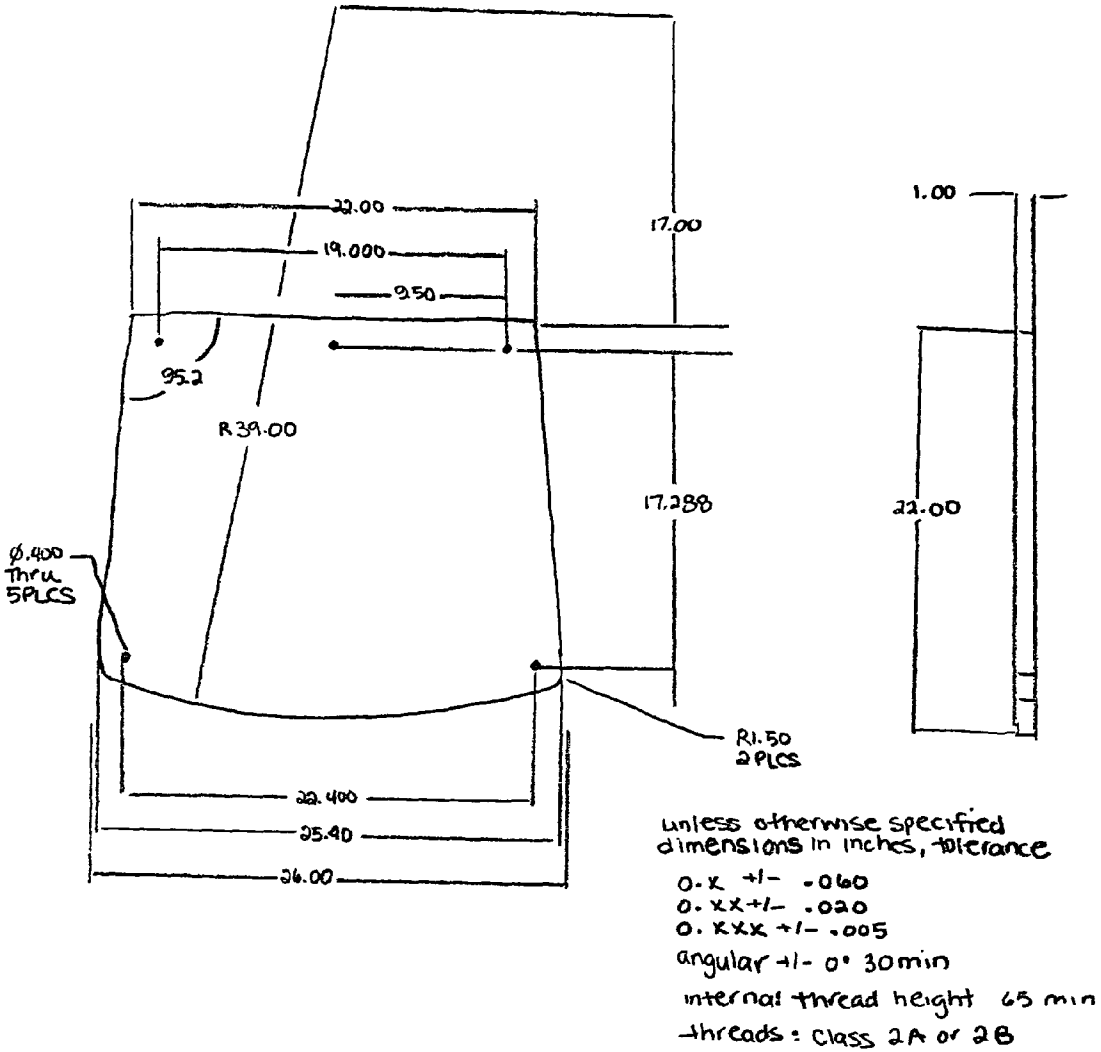
FIG. 7 is a plan view of an exemplary shelf of FIG. 1.

Shelves 110 (*a-d*) may be machined to a specific shape as shown in FIG. 7 but may be any variety of shapes and sizes based on the placement of the posts 140 and legs 150. The shape disclosed is not intended to be a limitation on the shape that may be utilized, one of skill in the art will appreciate that the shape could vary from that in the present embodiment. Depicted in the rack system 100 are three thru openings, such opening may be holes, for placement of the posts and legs, for each shelf 110 (*a-d*), two in front and one in the back. This is not intended to be a limitation on the number of thru openings that may be employed or the placement thereof. The number may vary and may be less or greater than that depicted in the present embodiment. Further the number of thru openings and placement of such may vary from shelf to shelf. The shelves 110 (*a-d*) offer additional dampening and stiffness for the rack structure 100. While four shelves 110 (*a-d*) are described in the present embodiment, this is not intended to be a limitation on the number of shelves that may be utilized, one of skill in the art will appreciate that the number could be less or greater than that given in the present embodiment.

The posts 140 may have any cross-sectional shape (i.e. circular, elliptical, square) but are preferably cylindrical in shape. The posts 140 may be constructed from any material with sufficient rigidity to support the system 100. Preferably the posts 140 are comprised entirely of carbon fiber. The posts 140 may be constructed from a carbon fiber composite material that is extruded or molded, i.e. as tubes or solid structures. Alternatively, the posts 140 may be comprised of multiple layers of carbon fiber sheets that are rolled over one another to create a tube. Such tubes are created from several sheets of carbon fiber, such as the sheets described above in conjunction with the carbon fiber veneer for the shelves. The tube is made by lay-up method or filament winding or other similar techniques. The number of carbon fiber sheets used to create a tube post may vary but is at least two and preferably three but may be comprised from many sheets.

At the end of each post 140 is an end cap 170 ($a_1$-$d_2$) and preferably two end caps which are bonded to each end of the tube by, structural epoxy or similar adhesives. End caps at the backmost posts 140 ($a_3$-$c_3$) are not shown. The end caps 170 ($a_1$-$d_2$) are constructed from axisymetric solid laminated carbon fiber epoxy composite laminates with an oblique angle between the plane of laminate and top plane of the end cap to provide optimal stiffness and damping. More preferably the angle is about 20 degrees. The end cap may also be made from chopped carbon fiber epoxy using a molding or extruding process, in addition other similar methods maybe used to fabricate this part. Regardless of fabrication method, the carbon fiber is cut in the preferred optimal angle.

The post 140 structure is designed to offer optimized mid and high range damping along with high stiffness. While three posts 140 are shown between each shelf in the present embodiment, this is not intended to be a limitation on the number of posts 140 that may be utilized, one of skill in the art will appreciate that the number could be less or greater than that given in the present embodiment.

The posts may be the primary structural damping components in the system 100. The posts support the shelves and therefore the equipment sitting on the shelves. The posts also isolate each shelf from the other shelves, the floor and the outside world. When constructed of carbon fiber, the posts are optimized to protect against deformation caused by vibration while dissipating vibration very effectively. As such the posts are most preferably made from 100% carbon fiber epoxy composite. The posts allow the vibration and other forces to be transferred through the rack(the posts, shelves, and legs) to the floor.

The legs 150 may have any cross-sectional shape, i.e. circular, elliptical or square, but are preferably cylinder in shape. The legs 150 may be constructed from any material with sufficient rigidity to support the system 100. Preferably the legs are comprised entirely of carbon fiber. The legs 150 may be constructed from carbon fiber composite materials that is extruded or molded, i.e. as tubes or solid structures. Alternatively, the legs 150 may be comprised of multiple layers of carbon fiber sheets that are rolled over one another to create a tube. The tubes are created from several sheets of carbon fiber, such as the sheets described above in conjunction with the carbon fiber veneer for the shelves. The tube is made by lay-up method or filament winding or other similar techniques. The number of carbon fiber sheets used to create a tube leg may vary but is at least two and preferably three but may be comprised from many sheets.

Figure 6:
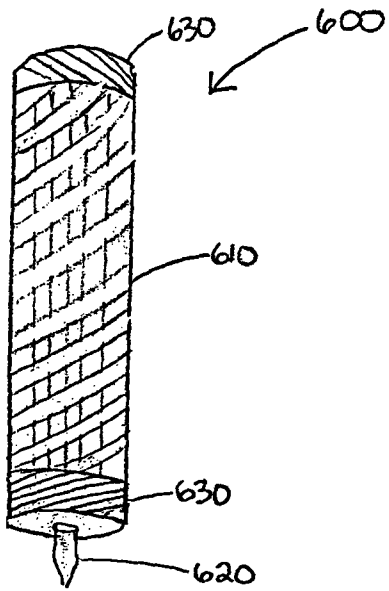
FIG. 6 is a side view of an exemplary leg of FIG. 1.

The legs 150 are below the bottom shelf. In one embodiment, FIG. 6 a exemplary leg structure 600 is shown. A spike 620 is screwed or otherwise positioned into the down end of a leg 610 which may be in contact with the floor or other surface. The exemplary leg structure 600 is constructed from carbon fiber veneers, also shown are end caps 630. The spike 620 may be a metal spike or a fiberglass spike or any other suitable material. In other embodiments a conical or cylindrical foot is used in place of a spike, the foot is preferably constructed from a carbon fiber or carbon fiber composite material using the same principles as applied to the end caps 170 While three legs 150 are described in the present embodiment, this is not intended to be a limitation on the number of legs 150 that may be utilized, one of skill in the art will appreciate that the number could be less or greater than that given in the present embodiment.

Preferably the posts and legs have the same size diameter however, one skilled in the art will appreciate that the leg and posts may have different size diameters. The diameter of the legs and post is generally 0.75-3 inches inclusive and preferably 1.5 inches.

Figure 5:
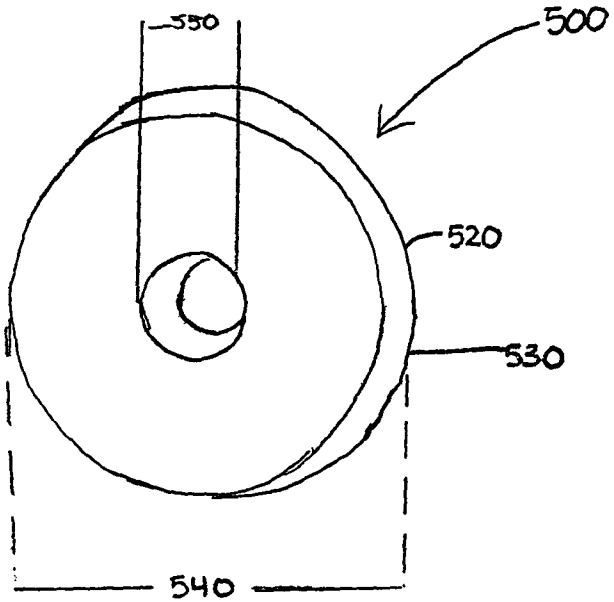
FIG. 5 is a side view of an exemplary urethane ring of FIG. 1.

Pre-compressed rings 130 are placed under the shelves 110 (*a-d*) and on top of the posts 140 (rings may also be placed on the upper surface of the shelf). While one ring is shown at each placement, this is not intended to be a limitation and more than one ring could be incorporated. Furthermore, while the embodiment depicts rings, other shapes are also contemplated within the scope of the present invention. The rings 130 isolate and damp low frequency vibration. An exemplary ring 500 is shown in FIG. 5 The ring 530 is preferably between 0.25 and 0.75 inch thick 520 and more preferably 0.5 inch thick. The ring 530 is constructed from urethane material and more preferably is constructed from an energy absorbing polyurethane material such as Sorbothane®, as manufactured by Sorbothane, Inc. of Kent Ohio. These materials provide very good damping at low frequencies up to a few hundred Hz. However, this is not intended to be a limitation on the material from which the rings 130 may be constructed and one of skill in the art will appreciate that other types of elastomers or viscoelastic materials maybe utilized. The outer diameter 540 of the ring is preferable the same as that of the posts and legs and the inside diameter 550 is preferably sized to allow a ⅜ inch bolt through it. However, this is not intended to be a limitation on the size of the inside diameter 550 and the inside diameter size may vary including being sized to allow a ¼ to ½ inch bolt. Rings 130 are provided with the same size central opening as the thru openings in shelves. While preferred dimensions are provided, such are not intended to be a limitation on the scope of the invention.

The nut 120 also referred to as the "top nut," is preferably constructed from a carbon fiber epoxy composite constructed with the same principles as those applied to the end caps. The nut 120 secures the top shelf to the rack. As depicted the nut is a cylindrical piece having a threaded opening in which to receive the stud, however, other shapes are anticipated within the scope of the present invention.

Figure 3:
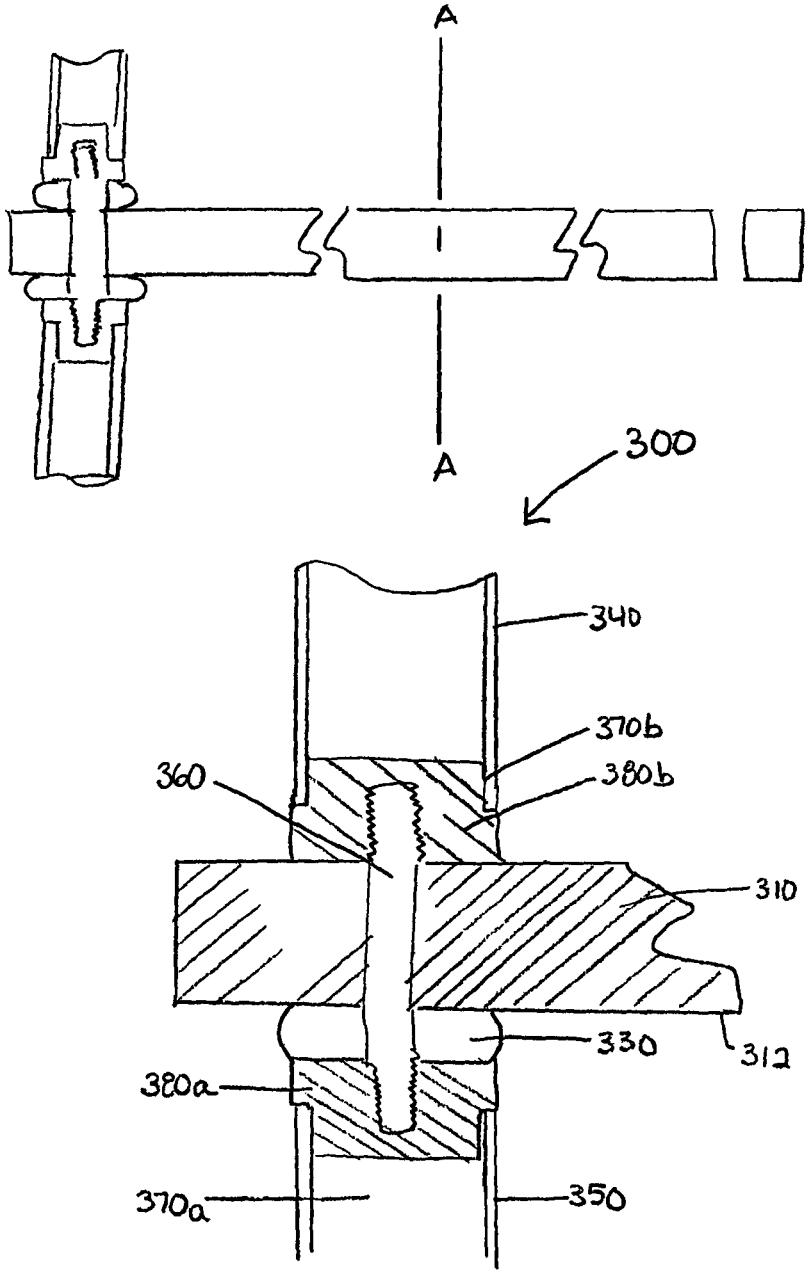
FIG. 3 is a cross-sectional view of an exemplary shelf configuration of FIG. 1.

Turning now to FIG. 3, a cross sectional view 300 of a shelf configuration taken across A-A is shown. A shelf 310 is connected to a post 340 and a leg 350 by a stud 360. Adjacent bottom surface 312 of the shelf 310 is a ring 330. Each post and leg has a bonded joint 370(*a-b*) and an end cap 380 (*a-b*).

Figure 4:
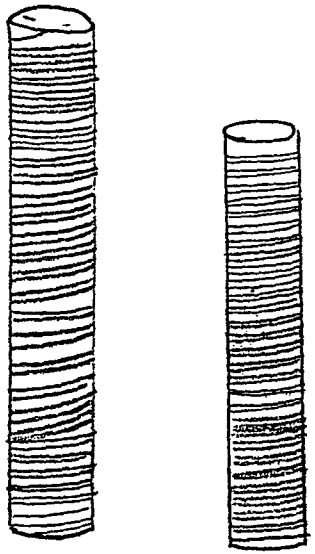
FIG. 4 is a side view of an exemplary stud of FIG. 1.

The stud 360 may be a threaded stud which screws to the post 340 or leg 360 or top nut (not shown) to attached the various parts of a system such as that depicted in FIG. 1. The stud may be threaded only on a portion of its length or the stud may be thread along its entire length as shown in FIG. 4. If the stud is threaded only along a portion of its length it is threaded a sufficient portion to enable adequate attachment. Other mechanical connections for the studs to the post legs and nuts are anticipated and contemplated within the scope of the present invention. Preferably, the stud is a fiberglass stud constructed from fiberglass nylon or other fiberglass plastic composites. Less preferably, the stud maybe constructed from a metal material. Alternatively, the stud may not be a separate part but instead may be an integral part of the post or leg or top nut. While depicted as having a circular cross section, other shapes are anticipated within the scope of the present invention.

The isolation rack system 100 may be constructed by screwing a fiberglass stud all the way to one end of a leg. The free end of the stud then inserted thru a bottom shelf hole and a post is screwed tightly to the exposed stud so the shelf is sandwiched between the leg and the post. This process is repeated three times. The spikes are then screwed all the way to the bottom side of the legs. A stud is then screwed to the top free side end of the standing post. A ring is placed on top of the post so the stud is inserted thru its hole. Again this procedure is repeated three times. A second shelf is placed on the rings so the studs go thru the three shelf openings.

Figure 8:
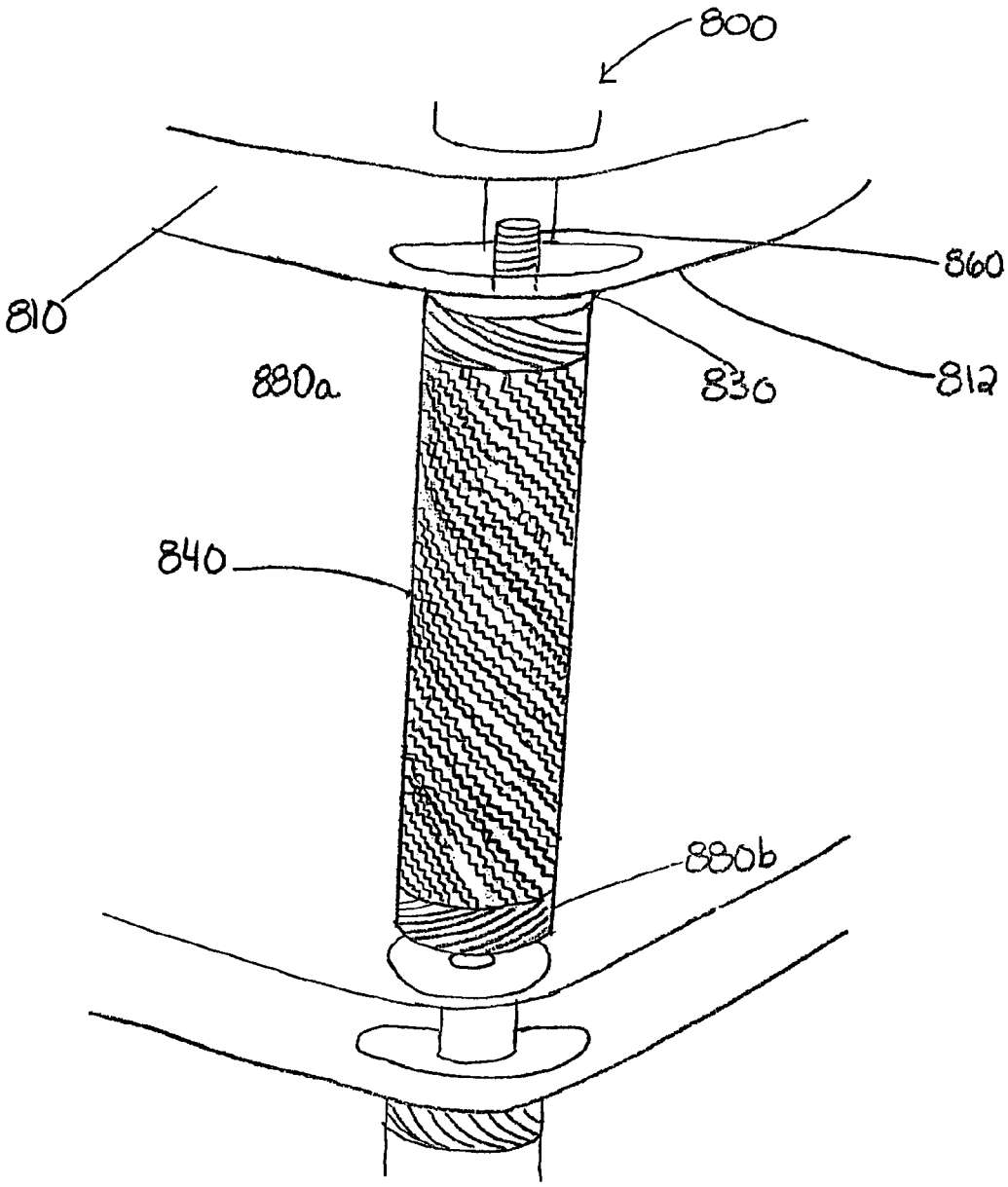
FIG. 8 is side view of an exemplary shelf and post configuration in accordance with an embodiment of the invention.

A post is then screwed onto the exposed stud lightly (figure tight, stopping as any resistance is felt). Noting the orientation of the parallel lines on top of the post, the post is tighten one complete turn compressing the ring. The compressed ring is now under an exact pre-load condition resulting in the best damping against low frequency vibration. The process is again repeated three times. FIG. 8 is an exemplary shelf and post configuration 800. A shelf 810 is connected to a post 840 by a stud 860. Adjacent to the bottom surface 812 of the shelf 810 is a compressed ring 830. The post 840 has a bonded joint (not shown) and end caps 880 (*a-b*).

This construction technique results in the shelf essentially floating on the preloaded ring. Accordingly, the load of the shelf is transferred to the ring on the top of the post and through the posts and legs to the floor.

If third and fourth shelves are required as depicted in FIG. 1; the above procedure is repeated for these additional shelves. Then a top nut is screwed onto the top shelf exposed stud, repeating it three times for all three exposed studs.

For a 70 durometer ring, the preload amounts to 35 lbs per ring. Therefore a shelf is pressed up by 105 lbs. As a result, components up to 105 lbs will see exact amount of low frequency damping from the rings independent of components weight.

The weight of upper shelves and components is carried by the studs to the legs and floor. The rings only carry the preload compression and are not affected by the weight of the shelves and its component. For heavier than 105 lb components a harder ring material can be used so the pre load can be greater than 35 lbs.

The compressed rings also act as springs holding the shelf in place and exerting a constant load to the posts thereby enhancing their damping characteristics.

Since the shelves are made of materials that exhibit good damping and stiff materials, a one-inch thick shelf also has very good stiffness and weight, both necessary properties for dissipating vibration. Preferably, each shelf weighs about 20 lbs making the rack heavy and stable.

When fiberglass is utilized in the studs, the studs are also excellent for dissipating vibration, as the fiberglass makes very good damper and stiff components.

Furthermore, the carbon fiber composites damp and dissipate vibration energy at mid and high frequency ranges very effectively. Urethane materials are often used for damping low frequency. Sorbothane® is a very good material for damping low frequency up to a few hundred Hz. By combining the carbon fiber tube structure for mid frequency damping and laminated carbon fiber for higher frequency damping with Sorbothane® for low frequencies an isolation rack system such as that described in conjunction with FIG. 1 achieves a complete range of passive damping and vibration energy dissipation.

The isolation rack system 100 may reduce the harmful vibrations in all low, mid and high frequencies. This reduction is improved when the rack is constructed from Sorbothane® for low, tube carbon fiber structure for mid and solid carbon fiber for high frequency damping. Its stiff and heavy structure is essential for damping of vibration.

Figure 2:
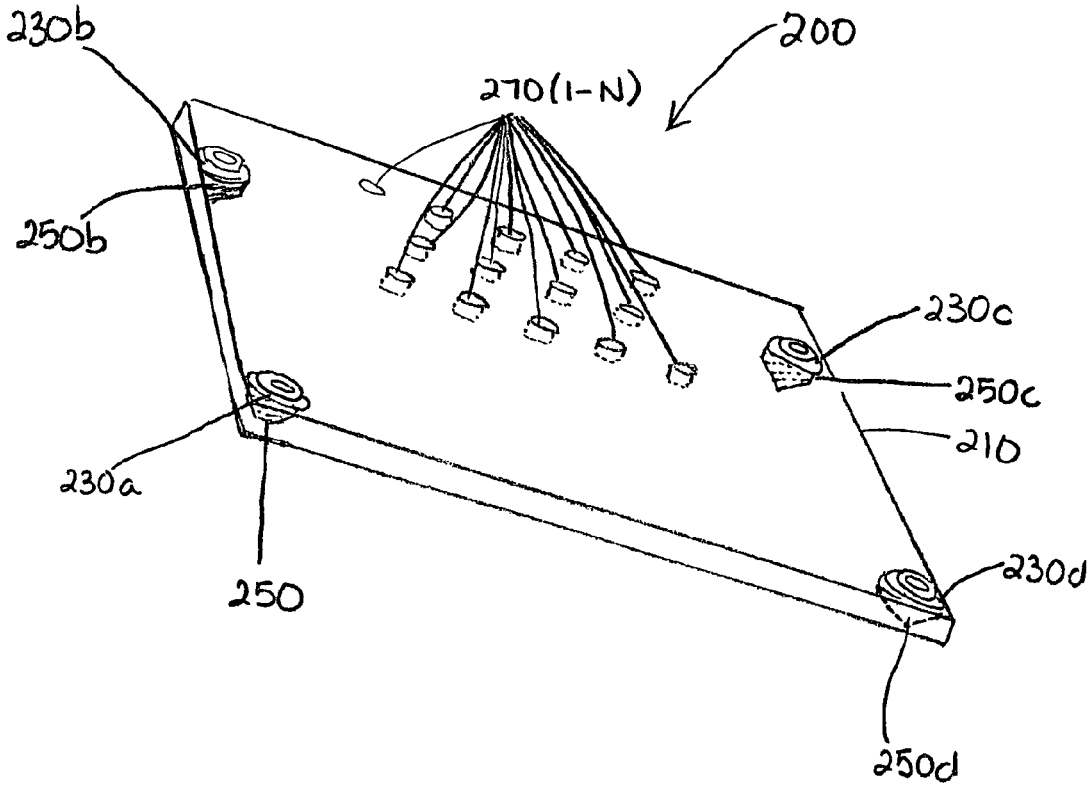
FIG. 2 is a perspective view of an audio/video shelf system in accordance with another embodiment of the present invention.

FIG. 2 illustrates a shelf system 200 for audio and video components constructed in accordance with an embodiment of the present invention. The shelf system 200 generally comprises a shelf 210 supported by conical feet 250 (*a-d*), the shelf 210 may alternatively be supported by a leg with a spike, conical foot or cylindrical pad or cylindrical pad alone as discussed previously. The conical feet 250 (*a-d*) are preferably constructed from a carbon fiber epoxy composite constructed using the same principles as those applied to the end caps discussed previously in conjunction with FIG. 1. Each conical foot 250 (*a-d*) is constructed with a threaded hole, that may act as an integral nut. A bolt (not shown) is used to secure the shelf 210 to the conical feet 250 (*a-d*) be means of a thru hole. Other mechanical fastening means are also contemplated within the scope of the present invention. The bolt is preferably constructed from fiberglass nylon or other fiberglass plastic composites. Less preferably, the bolt maybe constructed from a metal material. Adjacent to the bottom surface of the shelf 210 at each thru hole is a ring 230 (*a-d*). Each ring 230 (*a-d*) is positioned between the conical foot 250 (*a-d*) and the shelf 210. The shelf 210 may have multiple openings 270 (1-n) in the field surface of the shelf, as shown in the present embodiment the opening are holes. These holes 270 (1-n) provide air ventilation to ensure the audio or video component does not overheat. These openings also adjust the natural frequency of the shelf. One such purpose for this is so that the components do not evoke sympathetic vibration.

Although the present invention has been described with respect to the above exemplary embodiments, various additions, deletions and modifications are contemplated as being within its scope.

What is claimed is:

1. An apparatus comprising:

at least two shelves, each shelf defining a lower surface and a plurality of holes through each shelf;

posts positioned between and supporting the at least two shelves, each post defining an upper end adjacent one of the holes through the shelf;

legs positioned below and supporting the lowermost of the at least two shelves, each leg defining an upper end adjacent one of the holes through the shelf; and a plurality of precompressed dampening rings, each ring defining an upper surface, and further wherein each ring is positioned at one of the upper ends of the posts and the legs, and wherein each of the dampening rings is placed below the lower surface of each of the at least two shelves, and outside the hole through the shelf, wherein the lower surface of the shelf rests on the upper surface of the ring.

2. The apparatus of claim 1 wherein at least one of the posts has an integral stud that secures, to the post, the shelf that is supported by the post.

3. The apparatus of claim 1, wherein each of the posts includes an integral stud and wherein the studs secure the at least two shelves to the posts.

4. The apparatus of claim 3, wherein the studs further comprise fiberglass.

5. The apparatus of claim 1, further comprising nuts for securing the posts to the uppermost of the at least two shelves.

6. The apparatus of claim 1, further compromising an end cap at an end of each post.

7. The apparatus of claim 6, wherein the end cap is carbon fiber, laminated carbon fiber cut in an optimum bias angle or randomly oriented chopped fiber in a molding process.

8. The apparatus of claim 1, further comprising an end cap bonded to each end of each post.

9. The apparatus of claim 1, further comprising a spike located at the end of each leg.

10. The apparatus of claim 1, wherein at least one of the shelves further comprises a carbon fiber veneer on all sides.

11. The apparatus of claim 10, wherein the base material of the at least one shelf with the carbon fiber veneer is medium density fiber board.

12. The apparatus of claim 10, wherein the carbon fiber veneer further comprises ional metal wire.

13. The apparatus of claim 1, wherein at least one of the shelves further comprises an acrylic material.

14. The apparatus of claim 1, wherein at least one of the rings further comprises a viscoelastic material.

15. The apparatus of claim 14, wherein the viscoelastic material is a synthetic viscoelastic urethane polymer.

16. The apparatus of claim 15, wherein at least one of the rings is in a preloaded compression state.

17. The apparatus of claim 1, wherein the posts further comprise carbon fiber.

18. The apparatus of claim 1, wherein the legs further comprise carbon fiber.

19. The apparatus of claim 1, wherein the dampening rings are in an optimum pre-load state wherein the dampening rings are not affected by a weight of an object on the shelf.

20. The apparatus of claim 1, wherein the lowermost shelf is not impacted by the weight of the object on an uppermost shelf.

* * * * *